US006675626B2

(12) United States Patent
Arai

(10) Patent No.: US 6,675,626 B2
(45) Date of Patent: Jan. 13, 2004

(54) PRESS FORMING PROCESS AND PRODUCT FORMED THEREBY WITH HIGH DIMENSIONAL ACCURACY, AND WORKPIECE USED THEREFOR

(75) Inventor: Kenichi Arai, Tokyo (JP)

(73) Assignee: Fuji Jukogyo Kabushiki Kaisha, Tokyo (JP)

( * ) Notice: Subject to any disclaimer, the term of this patent is extended or adjusted under 35 U.S.C. 154(b) by 94 days.

(21) Appl. No.: 09/881,016

(22) Filed: Jun. 15, 2001

(65) Prior Publication Data

US 2001/0052255 A1 Dec. 20, 2001

(30) Foreign Application Priority Data

Jun. 16, 2000 (JP) ..... 2000-181063

(51) Int. Cl.[7] ..... B21D 5/00
(52) U.S. Cl. ..... 72/379.2; 72/701
(58) Field of Search ..... 72/168, 369, 379.2, 72/378, 411, 701; 29/897.35

(56) References Cited

U.S. PATENT DOCUMENTS 1,343,647 A * 6/1920 Smith ..... 72/379.2
1,356,567 A * 10/1920 Smith ..... 72/279.2
2,235,090 A * 3/1941 Stall et al. ..... 72/379.2

FOREIGN PATENT DOCUMENTS

JP 07148527 A 6/1995
JP 11226651 A 8/1999
RU 1013023 * 4/1983 ..... 72/378

* cited by examiner

*Primary Examiner*—Lowell A. Larson
(74) *Attorney, Agent, or Firm*—Smith, Gambrell & Russell, LLP

(57) ABSTRACT

A press forming process involves a stretching press to form a product with a curved portion from a workpiece by imparting a pad portion to the workpiece prior to starting the press forming process. The curved portion is prepared by spreading the pad portion mainly into the longitudinal direction of the workpiece, so that the curved portion is prepared so as to have a spring back of the product minimized.

8 Claims, 5 Drawing Sheets

PRESS FORMING PROCESS AND PRODUCT FORMED THEREBY WITH HIGH DIMENSIONAL ACCURACY, AND WORKPIECE USED THEREFOR

BACKGROUND OF THE INVENTION

1. Field of the Invention

The present invention relates to a press forming process, more specifically, a press forming process involving stretching press to form a product with a curved portion from a workpiece by which a product with high dimensional accuracy can be easily produced.

2. Discussion of the Related Art

In recent years, there is a demand that many sorts of industrial machines including vehicles should have decreased weight and designed for safety. As a concrete measure to answer such demand, steel with high tensile strength is employed, which has excellent processing characteristics, weldability, and impact resistance in addition to the high tensile strength, whereby it has become possible to decrease weight of the product with maintaining the strength thereof.

However, when steel with high tensile strength is employed as a material for obtaining a product therefrom such as a car frame, and is manufactured by a press forming involving stretching and/or bending, a so-called "spring back" occurs at a curved portion to a larger extent in comparison with commonly employed steel. Thus, it is still difficult to improve the dimensional accuracy of a product by the press forming.

The reason why the "spring back" occurs is to be explained with referring to FIG. 6.

FIG. 6 shows a frame 1 extended to include a curved portion, and having an approximate U-shaped cross-section formed with lateral walls 3 at both sides of a top face 2. The curved portions 4 of the lateral walls 3 are obtained by a stretching press forming operation in order to prepare the frame 1 by the press forming. At this stage, the length of the frame I on an outer side of the bending is insufficient to retain a formed shape at the curved portion 4 due to a tensile force.

The short length at the curved portion 4 causes a spring back of the product. In FIG. 6, the normal shape of the frame 1 shown by alternate long and two short dashed lines is deformed at the side under the tension to the direction shown by arrows X, whereby an undesirable product shown by a solid line is obtained. Consequently, the dimensional accuracy of the product is decreased.

A new press forming process is proposed, for instance, as disclosed in Japanese Kokai Publication 7 (1995)-148527 wherein a product is neatly bent to prepare a corner by a part of a workpiece being bent once to have a corner with a depression, and then the corner with the depression is pressed again so as to have a sharp corner. In accordance with this method, the stress distribution on the bent portion can be well balanced in the plate thickness direction, so that the generation of the spring back phenomenon is suppressed.

Furthermore, Japanese Kokai Publication 11 (1999)-226651 proposes a method wherein the shape of a die is prepared so as to partially differ from the shape of a product to be attained therefrom by estimating deformation of the product, e.g. spring back or warp, followed by performing press forming to give a product, thereby maintaining accuracy of the product.

In the methods described in the above-mentioned Japanese Patent Kokai Publications 7 (1995)-148527 and 11 (1999)-226651, it is necessary to carry out press forming by the dies having shapes that are largely different from the products to be obtained. The deformation behavior of the products, however, does not always follow the estimation, so that it is necessary to repeatedly perform tests for determining the final shapes of dies, and many manufacturing steps are required also in the actual manufacture.

OBJECTS AND SUMMARY OF THE INVENTION

It is therefore an object of the present invention to provide a press forming process involving a stretching press to form a product with a curved portion from a workpiece, wherein a product with high dimensional accuracy can be obtained by an occurrence of a spring back thereof being restrained without using many different dies by performing a step of providing a pad portion to the workpiece prior to starting the press forming process, the formation of the being completed by spreading the pad portion mainly in a longitudinal direction of the workpiece, whereby the curved portion is prepared so as to have a spring back of the product minimized.

Another object of the present invention is to provide the above-mentioned press forming process involving a stretching press to form a product with a curved portion from a workpiece, by which the above-mentioned pad portion is easily created, by the pad portion being in a wave, a bead or a corrugation form in the above-mentioned press forming.

A further object of the present invention is to provide the above-mentioned press forming process involving a stretching press to form a product with a curved portion from a workpiece, by which the occurrence of a spring back is effectively restrained, by the workpiece being made of a steel with a high tensile strength.

A still further object of the present invention is to provide the above-mentioned press forming process involving a stretching press to form a product with a curved portion from a workpiece, by which press forming is smoothly carried out by preventing parts of the workpiece from catching or sticking to a die to be used therefor, by the pad portion having a shape which does not interfere with the die.

A still further object of the present invention is to provide the above-mentioned press forming process involving a stretching press to form a product with a curved portion from a workpiece, by which the deformation of the product by the spring back is surely restrained by a portion of the workpiece to be stretched being substantially the same as that of a face of a plate holding member of a die used of the stretching press.

A still further object of the present invention is to provide a product with a curved portion, which has high dimensional accuracy even at the curved portion without causing spring back, prepared by a press forming process from a workpiece, the press forming process comprising providing a pad portion to the workpiece prior to starting the press forming process, and completing formation of the curved portion by spreading of the pad portion mainly in the longitudinal direction of the workpiece, whereby the curved portion is prepared so as to have a spring back of the product minimized.

A still further object of the present invention is to provide a workpiece appropriately used for the above-mentioned press forming process to obtain a product with a portion which has high dimensional accuracy even at the curved portion without causing spring back, by the provision of a pad portion at the a portion of the workpiece.

BRIEF DESCRIPTION OF THE DRAWINGS

A more complete appreciation of the invention and many advantages thereof will be readily obtained as the same becomes better understood by reference to the following detailed description when considered in connection with the accompanying drawings, wherein.

DETAILED DESCRIPTION OF THE INVENTION

In accordance with the press forming process of the present invention, the pad portion is prepared to absorb deformation which will occur, by a material added for producing the pad portion being stretched evenly to parts of the curved portion which is otherwise would be completed under high tension, so that, in the present invention, spring back caused by such high tension can be minimized. A primary die used for the present invention has a simple shape only with the pad portion. Therefore, it has been possible to obtain a product by press forming using a die which is roughly in the same shape as that of the workpiece. This makes it easy to determine the shape of the die, thereby saving the cost and time for manufacturing the die, and shortening the operating time.

Other feature of this invention will become understood in the course of the following description of embodiments, which are given for illustration of the invention and are not intended to be limiting thereof.

Figure 1:
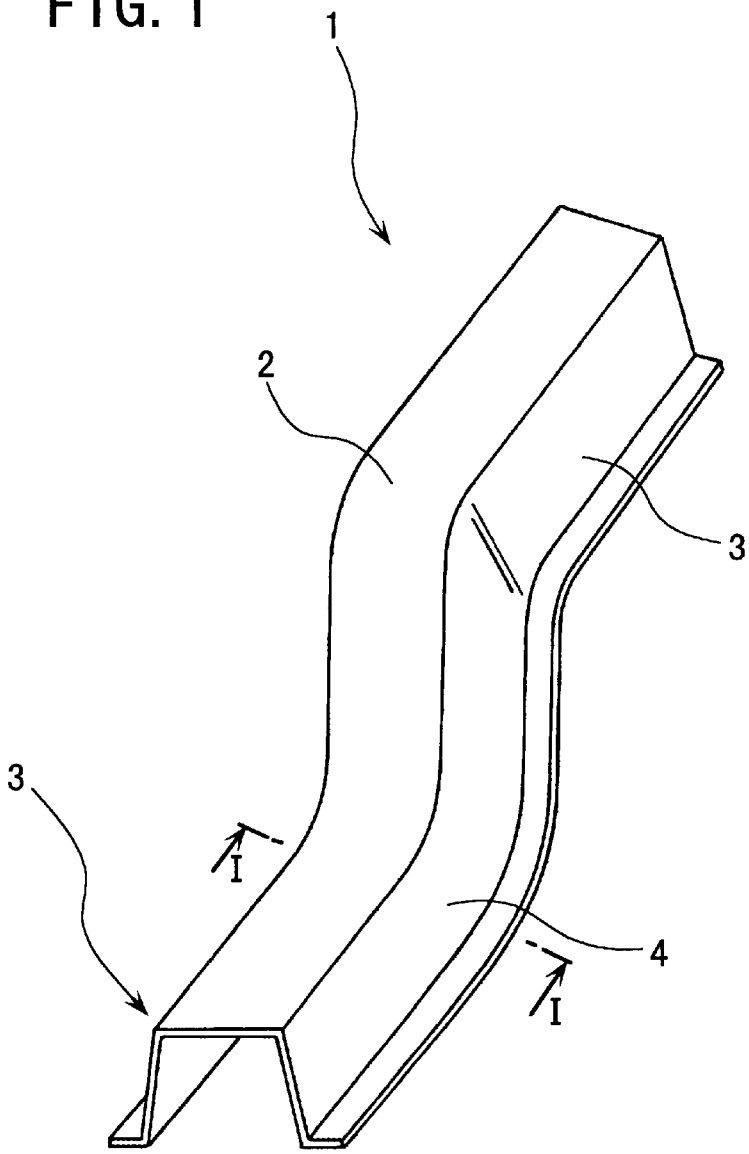
FIG. 1 is a perspective view of a product obtained by the press forming process according to the present invention.

In the present invention, a frame 1 as shown in the perspective view of FIG. 1 is obtained by a press forming process. The frame extends with a curved portion for instance as indicated by a reference numeral 4, having an approximate U-shaped cross-section formed with a top face 2 and lateral walls 3 provided at both sides of the top face 2. The press forming process for obtaining such a product will now be explained.

The process of the invention was attained for minimizing the spring back at the curved portion 4, which has occurred in the product produced by known methods. Such a spring back phenomenon occurs after the product with the curved portion under tension is prepared. The tensioned part of the product cannot maintain its shape and tends to inappropriately bend.

Figure 2:
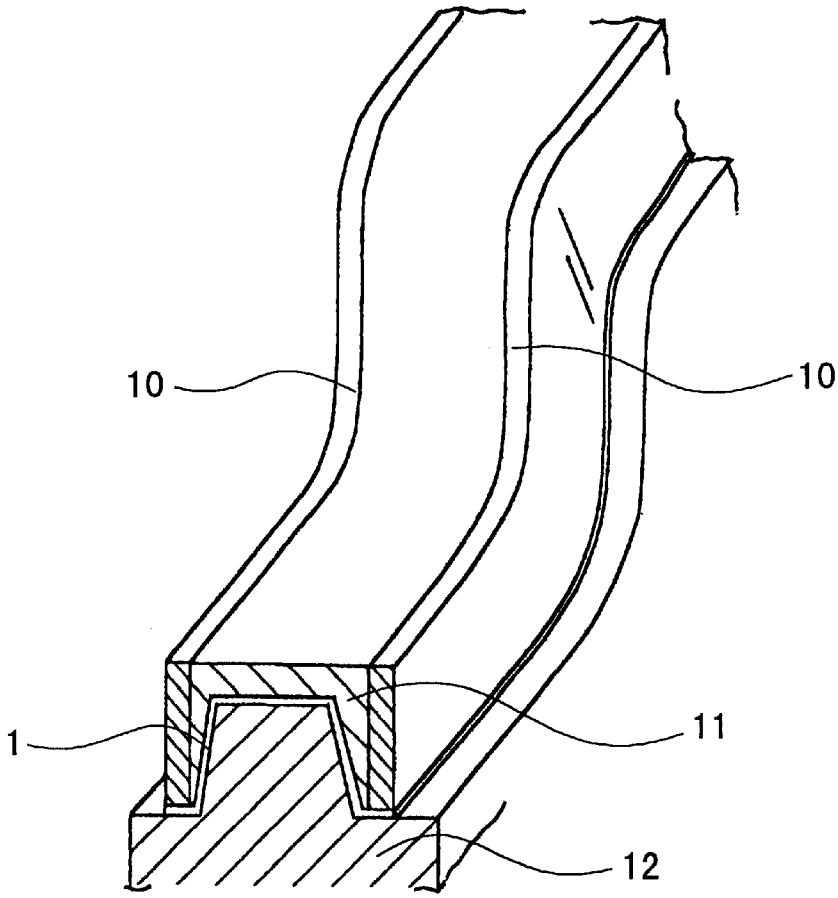
FIG. 2 is a perspective view of a product being pressed by means of a die by the aid of plate holding members.

The product 1 is produced by a die composed of a female die part 11 and a male die part 12 with plate holding members 10 as shown in FIG. 2. Because of the aforementioned reason, a short length at the curved portion 4 tends to appear, with respect to the corresponding length of the plate holding members 10. Therefore, a workpiece of the present invention has a primary curved portion with a pad portion as will be described in detail below, which is for preparing a product 1 including a curve part with enough length to minimize the occurrence of the spring back.

Figure 3:
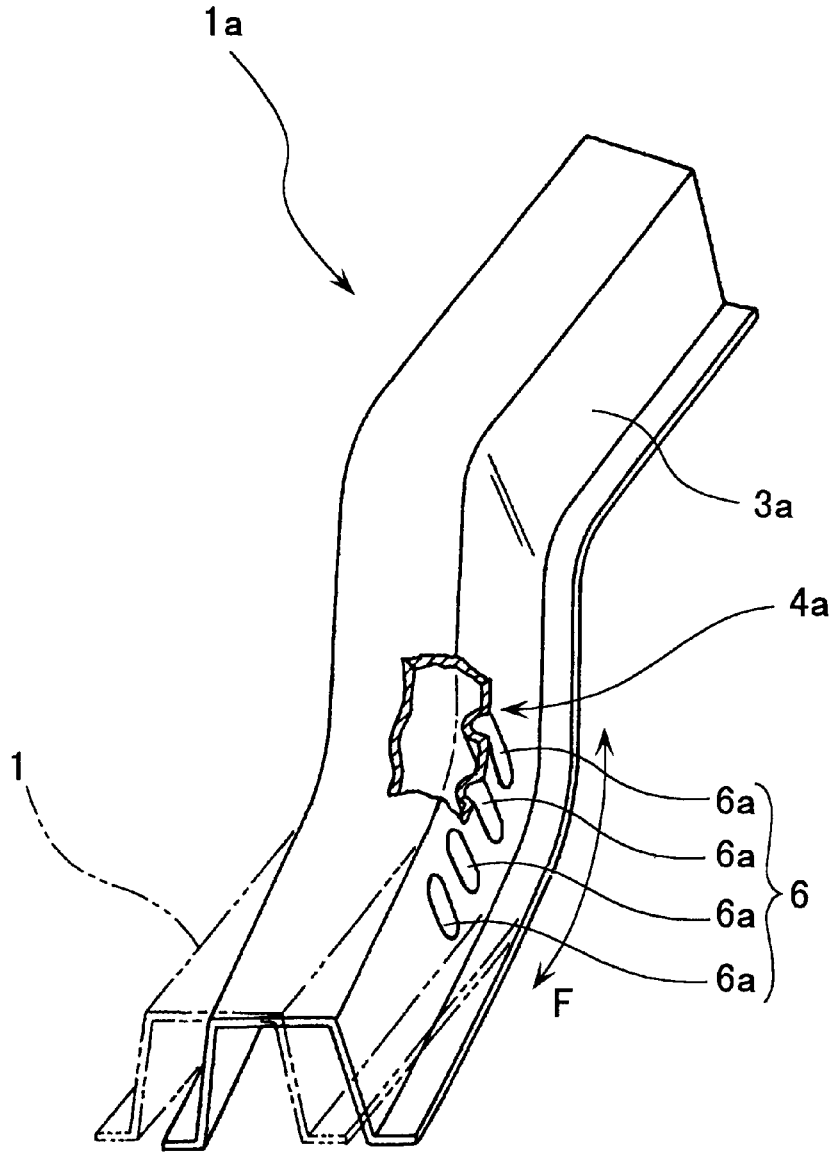
FIG. 3 is a perspective view of a workpiece for explaining an embodiment of a press forming process according to the present invention.

In an embodiment of the invention, drawing is carried out to obtain a primary formed article (i.e. a workpiece) with a pad portion 6 for the compensation of the short length to be appeared on a final product. The pad portion 6 is obtained as illustrated in FIG. 3 by drawing by a primary die for the primary formed article 1*a*, which pad portion 6 has a plurality of concave portions 6*a* with space therebetween, each extends almost vertically at the primary curved portion 4*a* crossing with the running direction of the primary formed article 1*a*. By the provision of a plurality of concave portions 6*a*, the primary curved portion 4*a* has a cross-section in a wave shape as shown in the partially broken view. The product 1 to be obtained after the secondary press forming is shown by an alternate long and two short dashes line.

Subsequently, the thus formed primary formed article 1*a* is subjected to press forming by a secondary die having a shape that is substantially the same as that of a product to be obtained. In the press forming, the primary curved portion 4*a* is subjected to a stretching press of the workpiece.

The pad portion 6 is pressed out in the direction shown by an arrow F while maintaining a continuous shape to a primary formed lateral wall 3*a*, whereby the primary curved portion 4*a* can be smoothly stretched, that is, without any irregularity, along the face of the above-mentioned plate holding member employed with the secondary die. As a result, the internal stress caused in the curved portion 4 is minimized, whereby the deformation of the obtained formed product by spring back can be satisfactorily eliminated. Finally, a frame 1 as shown in FIG. 1 is obtained with high dimensional accuracy.

Figure 4:
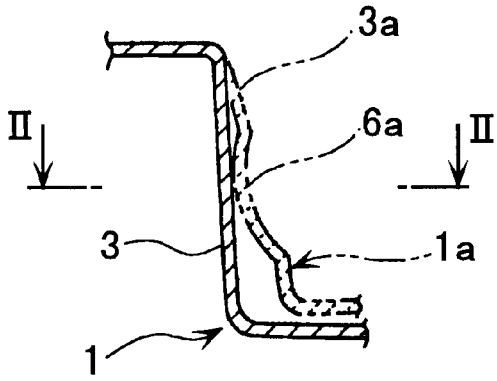
FIG. 4 is a cross-section of a part of the product shown in FIG. 1 cut along I—I.

FIG. 4 shows a cross-section of the frame 1 as a product shown in FIG. 1 cut along I—I for comparing the shape with respect to a cross-section of the primarily formed article 1*a* shown in FIG. 3.

Figure 5:
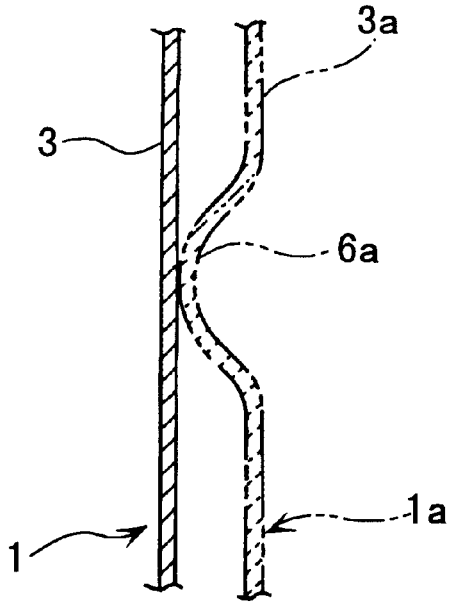
FIG. 5 is a cross-section of the part shown in FIG. 4 cut along II.
Figure 6:
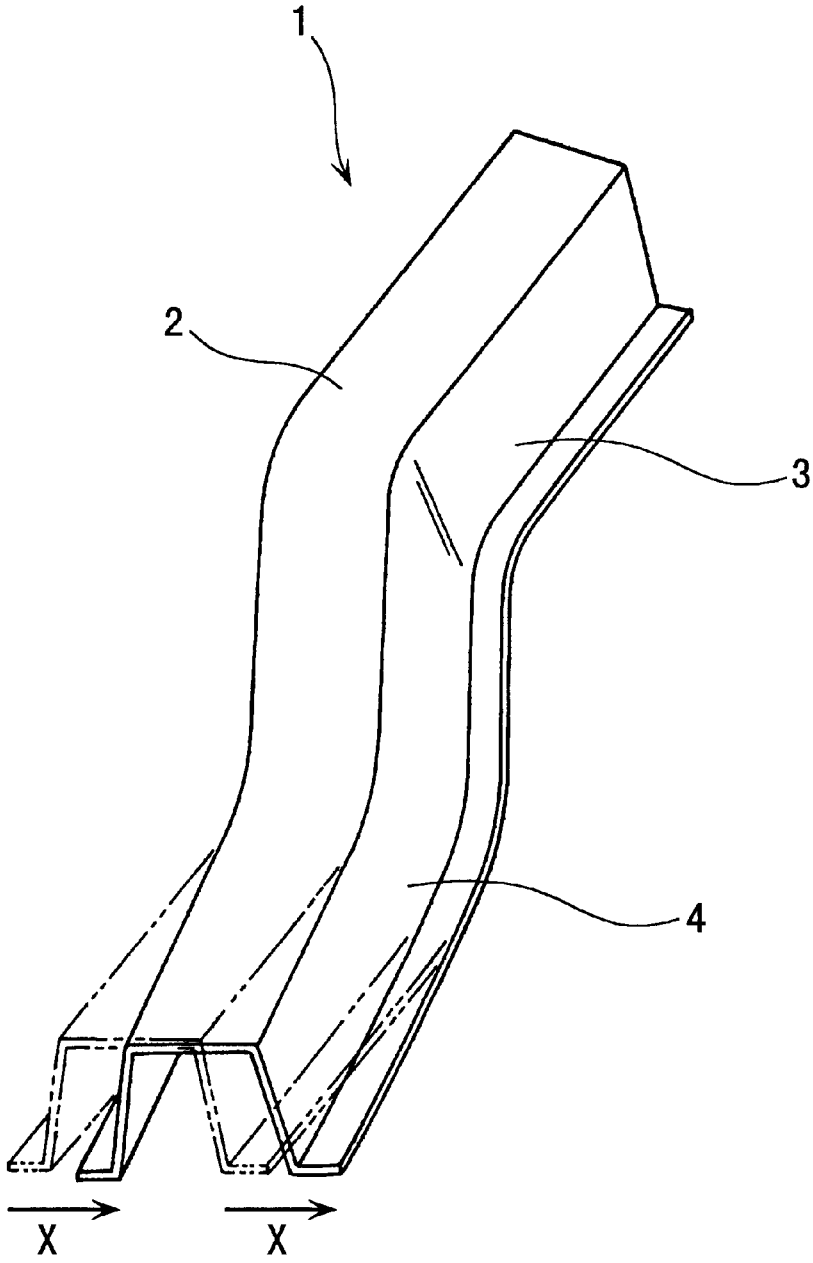
FIG. 6 is a perspective view of a product prepared by a known press forming process for explaining a spring back phenomenon.

Furthermore, FIG. 5 is a cross-section obtained by cutting the cross-section of FIG. 4 along II—II and seen from the top. The primary formed article 1*a* of which primary formed lateral wall 3*a* should be inwardly configured from the lateral wall 3 of the product 1 as shown in FIGS. 4 and 5. Since the primary formed article 1*a* in the present invention is prepared without having part protruded outwardly beyond the product 1 or the die, it is possible to avoid interference between the primary formed article 1*a* and the secondary die when the press forming is performed. Thus, the press forming is smoothly carried out.

As described above, the primary formed article 1*a* is obtained in a simple shape having a plurality of concave portions 6*a* at the primary curved portion 4*a* by the die having a shape that is very close to that of the product. According to the present invention, it is possible to easily determine the shape of the die to be used since no deformation substantially occurs on the final product. Therefore, the cost for manufacturing the die is saved, the time period for manufacturing the die is shortened, and in addition, the forming operating time of minimized.

Furthermore, it is preferable that the edge length and shape of the primary curved portion be made to be approximately the same as that of the face of the plate holding member. The deformation caused by the spring back can be completely eliminated by making the primary curved portion correspond to the face of the plate holding member.

In the above embodiment, it is also possible to prepare the pad portion 6 in a bead or corrugation shape or the like instead of the above-mentioned wave shape.

The present invention has been explained based on the embodiment for manufacturing a frame for a vehicle by press forming. In the alternative, the method of the invention can be applied for the manufacture of any other products obtained by press forming wherein a stretching press operation is carried out.

As is understood from the above, the present invention provides a press forming process by which the product with high dimensional accuracy can easily be obtained, by the preparation of the pad portion at the part where a stretching press is carried out. By the process of the invention, the deformation of the product by spring back can be eliminated. In the present invention, it is not necessary to prepare a die which has a shape that is largely different from the product to be obtained. Additionally, it is possible to press the primary formed article by the die which has a similar shape to that of the product. The shape of the die employed for the press forming can be readily determined under the pre-assumption of a deformation behavior of the workpiece. Hence, it is possible not only to save the manufacturing cost of the dies and the preparation time period thereof, but also to shorten the operating time.

The invention being thus described, it will be understood that the same may be varied in many ways. Such variations are not to be regarded as a departure from the spirit and scope of the invention, and all such modification as would be understood to one skilled in the art are intended to be included within the scope of the following claims.

What is claimed is:

1. A press forming process using a stretching press to form a product with a curved portion in a lateral wall of a workpiece having approximately the same shape as that of said product, comprising:

providing a pad portion in said lateral wall of said shaped workpiece prior to starting the press forming process using said stretching press, and completing formation of said shaped workpiece by using said stretching press to stretch said lateral wall at said curved portion to deflect the lateral wall in a direction (X) that is perpendicular to the longitudinal direction of the lateral wall and thereby spread said pad portion at said curved portion mainly in a longitudinal direction of said shaped workpiece while maintaining a continuous shape to said lateral wall whereby said curved portion of said lateral wall is prepared so as to have a spring back in the direction (X) that is perpendicular to the longitudinal direction of the lateral wall of said product minimized.

2. The press forming process as claimed in claim 1, wherein said pad portion is at least one of a wave, a bead and a corrugation form.

3. The press forming process as claimed in claim 2, wherein said workpiece is made of a steel with a high tensile strength.

4. The press forming process as claimed in claim 1, wherein said workpiece is made of a steel with a high tensile strength.

5. A product prepared by a press forming process using a stretching press to form a high tensile strength steel product with a curved portion in a lateral wall of a workpiece having approximately the same shape as that of said product, said press forming process comprising:

providing a pad portion in said lateral wall of said workpiece prior to starting the press forming process using said stretching press, and completing formation of said curved portion by using said stretching press to stretch said lateral wall at said curved portion to deflect the lateral wall in a direction (X) that is perpendicular to the longitudinal direction of the lateral wall and thereby spread said pad portion mainly in the longitudinal direction of said workpiece while maintaining a continuous shape to said lateral wall, whereby the lateral wall is curved in a direction (X) perpendicular to the longitudinal direction of the lateral wall and said curved portion of said lateral wall is prepared so as to have a spring back in the direction (X) that is perpendicular to the longitudinal direction of the lateral wall of said product minimized.

6. A U-shaped workpiece with a top face and lateral walls made of high tensile strength steel for providing a product which is dimensionally accurate and which, after a secondary stretching process to deflect the lateral wall in a direction (X) that is perpendicular to the longitudinal direction of the lateral wall, has a curved portion in one of the lateral walls, said workpiece being approximately in the same shape as that of said product and wherein the one lateral wall has a pad portion with concave portions, each of which extends perpendicular to the top face of the workpiece at the curved portion of the lateral wall and being used in a press forming process to minimize spring back in the direction (X) that is perpendicular to the longitudinal direction of the lateral wall of said product.

7. A press forming process using a stretching press to form a high tensile strength car frame product with a curved portion in a lateral wall of a workpiece having approximately the same shape as that of said product, comprising:

providing a pad portion in said lateral wall of said workpiece prior to starting the press forming process, wherein said pad portion is in the form of a wave, bead or corrugation, and completing formation of said workpiece by stretching said lateral wall at said curved portion to deflect the lateral wall in a direction (X) that is perpendicular to the longitudinal direction of the lateral wall and thereby spreading said pad portion mainly in a longitudinal direction of said workpiece while maintaining a continuous shape to said lateral wall, whereby said curved portion of said lateral wall is prepared so as to minimize spring back in the direction (X) that is perpendicular to the longitudinal direction of the lateral wall of said product.

8. A high tensile strength car frame product prepared by a press forming process using a stretching press to form a product with a curved portion in a lateral wall of a workpiece having approximately the same shape as that of said product, said press forming process comprising:

providing a pad portion in said lateral wall of said workpiece prior to starting the press forming process, wherein said pad portion is in the form of a wave, bead or corrugation, and completing formation of said curved portion by stretching the lateral wall at said curved portion to deflect the lateral wall in a direction (X) that is perpendicular to the longitudinal direction of the lateral wall spreading of said pad portion mainly in the longitudinal direction of said workpiece, whereby said curved portion is prepared so as to have a spring back in the direction (X) that is perpendicular to the longitudinal direction of the lateral wall of said product minimized.

* * * * *